US007896720B2

(12) United States Patent
Suzuki et al.

(10) Patent No.: US 7,896,720 B2
(45) Date of Patent: Mar. 1, 2011

(54) METHOD OF PRODUCING SPARK PLUG, AND SPARK PLUG

(75) Inventors: Akira Suzuki, Nagoya (JP); Tomoaki Kato, Nagoya (JP)

(73) Assignee: NGK Spark Plug Co., Ltd., Nagoya-Shi, Aichi (JP)

( * ) Notice: Subject to any disclaimer, the term of this patent is extended or adjusted under 35 U.S.C. 154(b) by 182 days.

(21) Appl. No.: 12/065,672

(22) PCT Filed: Mar. 12, 2007

(86) PCT No.: PCT/JP2007/054855

§ 371 (c)(1),
(2), (4) Date: Mar. 4, 2008

(87) PCT Pub. No.: WO2007/105695

PCT Pub. Date: Sep. 20, 2007

(65) Prior Publication Data

US 2009/0189502 A1 Jul. 30, 2009

(30) Foreign Application Priority Data

Mar. 14, 2006 (JP) ..... 2006-068485

(51) Int. Cl.
*H01T 21/02* (2006.01)
*H01T 13/20* (2006.01)
*F02M 57/06* (2006.01)
*F02P 13/00* (2006.01)

(52) U.S. Cl. ..... 445/7; 313/141; 313/118

(58) Field of Classification Search ..... None
See application file for complete search history.

(56) References Cited

U.S. PATENT DOCUMENTS 3,857,145 A * 12/1974 Yamaguchi et al. ..... 445/7

(Continued)

FOREIGN PATENT DOCUMENTS

CN 1038549 A 1/1990

(Continued)

OTHER PUBLICATIONS

The State Intellectual Property Office of P.R. China, Office Action for related Chinese Application No. 2007800000962.5, issued Jun. 25, 2010.

*Primary Examiner*—Toan Ton
*Assistant Examiner*—Britt D Hanley
(74) *Attorney, Agent, or Firm*—Stites & Harbison PLLC; Jeffrey A. Haeberlin

(57) ABSTRACT

A method of producing a spark plug includes reducing the diameter of a center electrode while maintaining the heat dissipation property of the center electrode. A columnar member in which an outer skin member and a core member having a high thermal conductivity are clad, and which is columnarly extended, are configured by extrusion molding into a state where the thickness of the outer skin member is substantially uniform. A flange portion and a tip end portion are formed in the columnar member to obtain an electrode intermediate member. In a middle trunk portion of the electrode intermediate member, the thickness of the outer skin member is maintained. Then, the surface of the middle trunk portion is cut or polished to reduce the thickness, whereby the diameter of a center electrode is reduced while maintaining the outer diameter of the core member.

7 Claims, 5 Drawing Sheets

U.S. PATENT DOCUMENTS

| | | | | |
|---|---|---|---|---|
| 4,324,588 | A * | 4/1982 | Zysk et al. | 419/28 |
| 4,684,352 | A * | 8/1987 | Clark et al. | 445/7 |
| 4,840,594 | A | 6/1989 | Moore | |
| 5,310,373 | A | 5/1994 | Treiber et al. | |
| 2005/0057135 | A1 * | 3/2005 | Yoshimoto et al. | 313/141 |

FOREIGN PATENT DOCUMENTS

| | | | |
|---|---|---|---|
| CN | 1054508 | A | 9/1991 |
| JP | 404133282 | A * | 5/1992 |
| JP | 8-213150 | | 8/1996 |

* cited by examiner

METHOD OF PRODUCING SPARK PLUG, AND SPARK PLUG

TECHNICAL FIELD

The present invention relates to a method of producing a spark plug which is to be used for ignition in an internal combustion engine, and also to a spark plug.

BACKGROUND ART

Conventionally, a spark plug for ignition is used in an internal combustion engine. A usual spark plug is configured by: an insulator which holds a center electrode in a tip end side of a shaft hole, and which holds a connecting terminal in a rear end side; a metal shell which surrounds and holds a trunk portion of the insulator; and a ground electrode in which one end is welded to the tip end of the metal shell, and the other end is opposed to the tip end of the center electrode to form a spark discharge gap.

The center electrode used in such a spark plug is formed by a highly refractory metal (for example, nickel). In order to further improve the refractoriness, an electrode is used in which a clad structure is configured with using a highly thermally conductive metal (for example, copper) as a core member, thereby enhancing the heat dissipation property. The center electrode having such a form is produced, for example, by extending a composite member in which a copper alloy is fitted into a cup formed by a nickel alloy, to a columnar shape by extrusion molding, and then applying a plastic working process on the extended member to obtain a desired electrode shape (for example, see Patent Reference 1).

Recently, in accordance with increase in output and reduction in fuel consumption of an automobile engine, it is requested to reduce the size and diameter of a spark plug from the viewpoint of the degree of freedom in design. In the case where a spark plug is produced while directly reducing the dimensions of components of a conventional spark plug, the clearance between a metal shell and an insulator is reduced, and there arises the possibility that a side spark occurs. A metal shell is restricted by the diameter of a screw for mounting to an engine, and also by the size of a ground electrode. Therefore, it is difficult to increase the inner diameter of the metal shell. When the thickness of the insulator is reduced in order to ensure the clearance, there is the possibility that the strength is lowered, or that the insulation is insufficient. When the outer diameter of the center electrode is thinned while the outer diameter of the insulator is reduced and the clearance with respect to the metal shell is ensured, consequently, the thickness of the insulator is not reduced and the strength can be maintained.

Patent Reference 1: JP-A-8-213150

DISCLOSURE OF THE INVENTION

Problems that the Invention is to Solve

In the center electrode, however, the diameter of the core member is reduced, and therefore the heat dissipation property is lowered. Therefore, there is the possibility that the refractoriness and hence the durability are lowered. In order to improve the refractoriness while reducing the diameter of the center electrode, a configuration may be employed where a measure for preventing the outer diameter of the core member from being thinned is taken, and only the thickness of the outer skin member is reduced. In the plastic working process such as disclosed in Patent Reference 1, however, it is difficult to reduce only the thickness of the outer skin member.

The invention has been conducted in order to solve the above-discussed problem. It is an object of the invention to provide a method of producing a spark plug in which, in order to reduce the size of the spark plug, the diameter of a center electrode can be reduced while maintaining the heat dissipation property of the center electrode, and also such a spark plug.

Means for Solving the Problems

In order to attain the object, one aspect of the invention is a method of producing a spark plug comprising a center electrode which includes a core portion, and a cover portion covering the core portion, wherein the method comprises: a first step of applying a plastic working process on a blank member which is configured by joining a material that will be used as the core portion, to a material that will be used as the cover portion, thereby forming a first intermediate member which is columnar, and in which the cover portion covers the core portion; a second step of applying a plastic working process on the first intermediate member to form a second intermediate member having: a tip end portion; a bulging flange portion which is disposed on a rear end side with respect to the tip end portion, and which has a larger diameter than the tip end portion; and a columnar intermediate portion which is disposed between the tip end portion and the flange portion; and a third step of cutting or polishing a surface of the cover portion of the intermediate portion of the second intermediate member to form the center electrode having a middle trunk portion which is configured by reducing a diameter of the intermediate portion.

One implementation of the method is characterized in that in the second intermediate member, the cover portions in an axial center of the intermediate portion and the flange portion have a thickness of 0.3 to 0.4 mm.

Another implementation is characterized in that a hardness of the cover portion of the center electrode has a Vickers hardness of 270 Hv or more.

Another implementation is characterized in that in the third step, the surface of the cover portion of the intermediate portion of second intermediate member is cut or polished so that a ratio of a thickness of the cover portion of the middle trunk portion to a thickness of the cover portion of the flange portion is 0.8 or less.

Another implementation is characterized in that in the third step, the surface of the cover portion of the intermediate portion of second intermediate member is cut or polished so that a difference between a thickness of the cover portion of the flange portion and a thickness of the cover portion of the middle trunk portion is 0.05 mm or more.

Another implementation is characterized in that the intermediate portion has a length which is equal to one half or more of a whole length of the second intermediate member.

Another implementation is characterized in that in the third step, the surface of the cover portion of the intermediate portion is cut or polished over a whole length of the core portion positioned in the intermediate portion.

In order to attain the object, another aspect of the invention is a spark plug comprising: a center electrode having a tip end portion, a bulging flange portion which is disposed on a rear end side with respect to the tip end portion, and which has a larger diameter than the tip end portion, and a columnar middle trunk portion which is disposed between the tip end portion and the flange portion; an insulator which covers an outer circumference of the center electrode; a tubular metal shell which covers an outer circumference of the insulator; and a ground electrode which is joined to a tip end face of said metal shell, and which is placed so that one end of itself is opposed to the tip end portion of the center electrode, wherein the center electrode includes a core portion and a cover portion which covers the core portion, and a ratio of a thickness of the cover portion of the middle trunk portion to a thickness of the cover portion of the flange portion is 0.8 or less.

One implementation of the spark plug is characterized in that the ratio of the thickness of the cover portion of the middle trunk portion to the thickness of the cover portion of the flange portion is 0.5 or more.

Another implementation is characterized in that a difference between the thickness of the cover portion of the flange portion and the thickness of the cover portion of the middle trunk portion is 0.05 mm or more.

Another implementation is characterized in that the cover portion of the middle trunk portion has a thickness of 0.2 mm or more.

Another implementation is characterized in that, in addition the cover portion of the flange portion has a thickness of 0.3 to 0.4 mm.

Another implementation is characterized in that a distance between a tip end of the center electrode and a tip end of the core portion is 2 mm or less.

Effects of the Invention

In the method of producing a spark plug of the invention, the first intermediate member is produced by, in the first step, applying the plastic working process on the blank member which is configured by joining the material that will be used as the core portion, to the material that will be used as the cover portion. Usually, this process is performed by extrusion molding. By the step, the first intermediate member can be finished into a form in which the core portion is covered by the cover portion. By the process, the core portion and the cover portion can be uniformly extended, and hence the thickness of the cover portion can be set to a substantially uniform state. When the second intermediate member having the flange portion, the tip end portion, and the intermediate portion is produced in the second step, the flange portion and the tip end portion are formed by applying the plastic working process on the first intermediate member in which the cover portion covers the core portion as described above, and hence the thickness of the cover portion in the intermediate portion can be maintained to the substantially uniform state. When, in this state, the surface of the cover portion of the intermediate portion of the second intermediate member is cut or polished in the third step, only the thickness of the cover portion of the middle trunk portion can be reduced without changing the outer diameter of the core portion covered by the cover portion. Namely, the reduction of the diameter of the produced center electrode can be realized by reducing only the thickness of the cover portion. As described above, according to the invention, when the reduction of the diameter of the intermediate portion is performed in the third step, the rate of the core portion is relatively increased. Therefore, the outer diameter of the center electrode can be reduced while maintaining the heat dissipation property of the center electrode. The outer diameter of the tip end portion may be smaller than that of the intermediate portion, or alternatively may be equal thereto.

In the cutting or polishing of the cover portion in the third step, as the thickness of the cover portion is further reduced, the mechanical strength of the intermediate portion is further weakened. When the cover portion of the intermediate portion of the second intermediate member has a reduced thickness, consequently, there is the possibility that the intermediate portion may be broken because the portion receives a resistance force from a cutting blade or a whetstone in the third step. As one implementation of the invention, therefore, the thicknesses of the cover portions in the axial center of the intermediate portion of the second intermediate member and the flange portion are set to 0.3 to 0.4 mm. According to the configuration, the mechanical strength of the intermediate portion of the second intermediate member before performing the third step can be sufficiently ensured, and hence the breaking of the intermediate portion in the third step can be suppressed.

In the cutting or polishing of the cover portion in the third step, the mechanical strength of the intermediate portion is further weakened as the thickness of the cover portion is further reduced. Consequently, there is the possibility that the intermediate portion may be broken because the portion receives a resistance force from a cutting blade or a whetstone. When the hardness of the cover portion has a Vickers hardness of 270 Hv or more as another implementation of the invention of, however, a sufficient mechanical strength can be maintained even in a reduced thickness of the cover portion, and breakage can be prevented from occurring.

According to the method of producing a spark plug of another implementation, in the third step, the surface of the cover portion of the intermediate portion of second intermediate member is cut or polished so that the ratio of the thickness of the cover portion of the middle trunk portion to that of the cover portion of the flange portion is 0.8 or less. In the thus-produced spark plug, therefore, the rate of the core member in the middle trunk portion is relatively large, and hence the heat dissipation property of the center electrode can be ensured even when the middle trunk portion of the center electrode has a reduced outer diameter.

According to the method of producing a spark plug of another implementation, in the third step, the surface of the cover portion of the intermediate portion of second intermediate member is cut or polished so that the difference between the thickness of the cover portion of the flange portion and that of the cover portion of the middle trunk portion is 0.05 mm or more. Therefore, the thus-produced spark plug can sufficiently exhibit the heat dissipation property of the center electrode.

In order to further improve the heat dissipation property of the center electrode, the rate of the intermediate portion in which the cover portion is cut or polished in the third step, with respect to the second intermediate member may be increased. When, as in another implementation, the intermediate portion has a length which is equal to one half or more of the whole length of the second intermediate member, the cover portion having a length which is one half or more of the whole length of the second intermediate member is cut or polished in the third step. In the thus produced center electrode, therefore, a portion having a length which is one half or more of the whole length of the center electrode is formed as the middle trunk portion, and it is possible to further improve the heat dissipation property of the center electrode.

In order to effectively obtain the heat dissipation property of the center electrode, as in another implementation, the surface of the cover portion of the intermediate portion is cut or polished in the third step over the whole length of the core portion positioned in the intermediate portion. When, in the intermediate portion, the whole length of the core portion positioned in the intermediate portion is cut or polished as described above, the cover portion of a region where the core portion is positioned in the middle trunk portion can be thinned. In the thus produced center electrode, it is possible to effectively obtain the heat dissipation property.

In the spark plug of the invention, the ratio of the thickness of the cover portion of the middle trunk portion to that of the cover portion of the flange portion is 0.8 or less ((the thickness of the cover portion of the middle trunk portion/the thickness of the cover portion of the flange portion)≦0.8). In this way, the thickness of the cover portion of the middle trunk portion which is positioned on the tip end side with respect to the flange portion in the center electrode is made smaller than that of the cover portion of the flange portion, whereby the thermal conductivity of the cover portion of the middle trunk portion can be enhanced. As a result, heat conducted to the middle trunk portion can be promptly transmitted from the cover portion to the core portion, and the heat dissipation property of the center electrode can be improved. In the invention, particularly, the ratio of the thickness of the cover portion of the middle trunk portion to that of the cover portion of the flange portion is 0.8 or less. Even when the outer diameter of the middle trunk portion of the center electrode is reduced, therefore, the heat dissipation property of the center electrode can be ensured. According to the invention, consequently, a spark plug in which miniaturization can be attained while ensuring the heat dissipation property of the center electrode. The outer diameter of the tip end portion may be smaller than that of the middle trunk portion, or alternatively may be equal thereto.

There is a tendency that, as the thickness of the cover portion of the middle trunk portion is further reduced, the mechanical strength of the center electrode is further weakened although the heat dissipation property of the center electrode is further improved. In the spark plug of one implementation, therefore, the ratio of the thickness of the cover portion of the middle trunk portion to that of the cover portion of the flange portion is 0.5 or more ((the thickness of the cover portion of the middle trunk portion/the thickness of the cover portion of the flange portion)≦0.5). In this way, the ratio of the thickness of the cover portion of the middle trunk portion to that of the cover portion of the flange portion is 0.5 or more, whereby the mechanical strength of the center electrode can be ensured. According to the invention, in addition to the functions and effects of the invention of claim 8, therefore, a spark plug comprising a center electrode having a mechanical strength which is sufficient for a practical use can be configured.

In the spark plug of another implementation, the difference between the thickness of the cover portion of the flange portion and that of the cover portion of the middle trunk portion is 0.05 mm or more ((the thickness of the cover portion of the flange portion)−(the thickness of the cover portion of the middle trunk portion) 0.05 mm). In this way, the difference between the thickness of the cover portion of the flange portion and that of the cover portion of the middle trunk portion is 0.05 mm or more, whereby a spark plug in which the heat dissipation property of the center electrode is further improved can be configured.

In the spark plug of another implementation, the cover portion of the middle trunk portion has a thickness of 0.2 mm or more. According to the configuration, a spark plug in which the mechanical strength of the center electrode can be further improved, and the oxidation resistance performance of the center electrode is sufficiently ensured can be configured.

In the center electrode, the flange portion which is a portion butting against a step portion of the shaft hole of the insulator must have a mechanical strength which is higher than that of another portion. As in another implementation, therefore, the cover portion of the flange portion has a thickness of 0.3 to 0.4 mm, whereby a spark plug in which, in addition to the functions and effects of the invention, particularly the mechanical strength of the flange portion is ensured can be configured.

In the spark plug of another implementation, the distance between the tip end of the center electrode and that of the core portion is 2 mm or less. According to the configuration, a spark plug in which heat conducted from the tip end of the center electrode can be promptly transmitted to the core portion, and the heat dissipation property of the tip end portion of the center electrode is improved can be configured.

DESCRIPTION OF REFERENCE NUMERALS AND SIGNS

Figure 1:
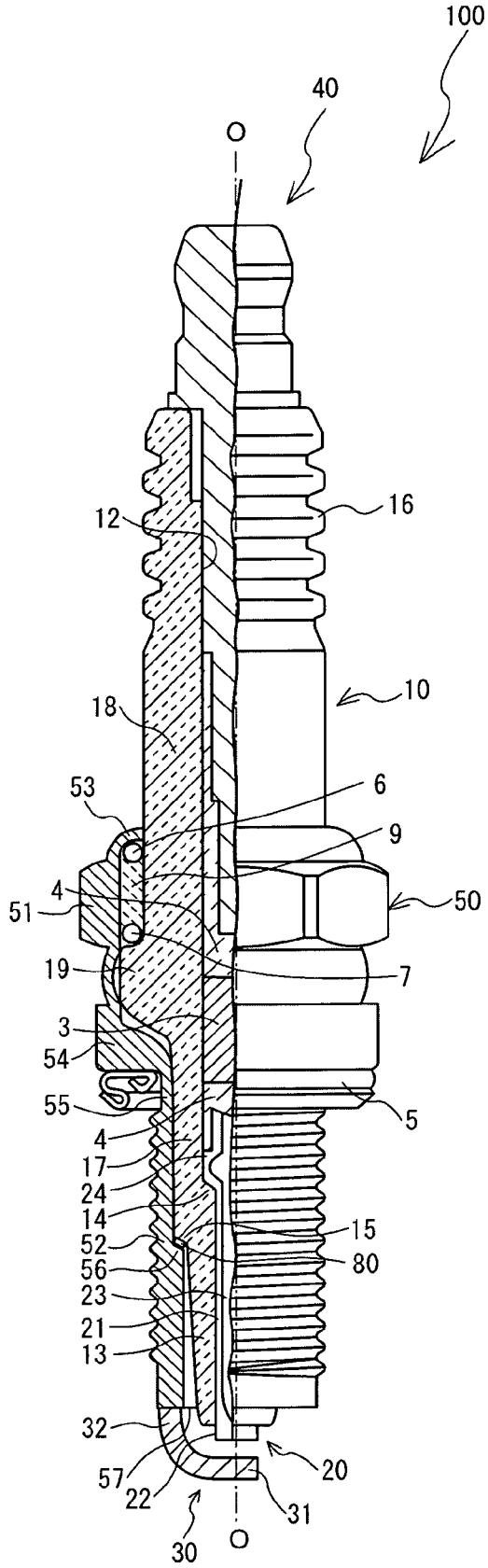
FIG. 1 is a partially sectional view of a spark plug 100.

10 insulator
20, 520, 620 center electrode
21, 521 outer skin member (cover portion)
23, 523, 623 core member (core portion)
25, 525 middle trunk portion
100 spark plug
120 composite member
121 cup member
123 axis member
220 columnar member
303, 803 intermediate portion
305 flange portion
320, 820 electrode intermediate member

BEST MODE FOR CARRYING OUT THE INVENTION

Hereinafter, an embodiment of a method of producing a spark plug in which the invention is embodied will be described with reference to the accompanying drawings. First, the structure of a spark plug 100 produced by the production method of the embodiment will be described. FIG. 1 is a partially sectional view of the spark plug 100. The following description will be made assuming that, in the direction of the axis O, a side where a center electrode 20 is held in a shaft hole 12 of an insulator 10 is the tip end side of the spark plug 100.

As shown in FIG. 1, the spark plug 100 is generally configured by: the insulator 10; a metal shell 50 which is disposed in a substantially middle portion in the longitudinal direction of the insulator 10, and which holds the insulator 10; the center electrode 20 which is held in the shaft hole 12 of the insulator 10 in the direction of the axis O; a ground electrode 30 in which a basal portion 32 is welded to a tip end face 57 of the metal shell 50, and a tip end portion 31 is opposed to a tip end portion 22 of the center electrode 20; and a terminal post 40 which is disposed on the rear end side of the insulator 10.

First, the insulator 10 which constitutes an insulating member of the spark plug 100 will be described. As well known, the insulator 10 is a cylindrical insulating member which is formed by firing alumina or the like, and which has the shaft hole 12 in the direction of the axis O. In a substantially middle in the direction of the axis O, a flange portion 19 which has the largest outer diameter is formed, and, on the rear end side with respect to this portion, a rear end side trunk portion 18 is formed. On the rear end side with respect to the rear end side trunk portion 18, a corrugation portion 16 which increases the creepage distance is formed. On the tip end side with respect to the flange portion 19, a tip end side trunk portion 17 in which the outer diameter is smaller than that of the rear end side trunk portion 18 is formed. On the tip end side with respect to the tip end side trunk portion 17, a long-leg portion 13 in which the outer diameter is smaller than that of the tip end side trunk portion 17. As further advancing toward the tip end side, the diameter of the long-leg portion 13 is further reduced. When the spark plug 100 is mounted in an internal combustion engine which is not shown, the long leg portion is exposed to a combustion chamber.

Figure 2:
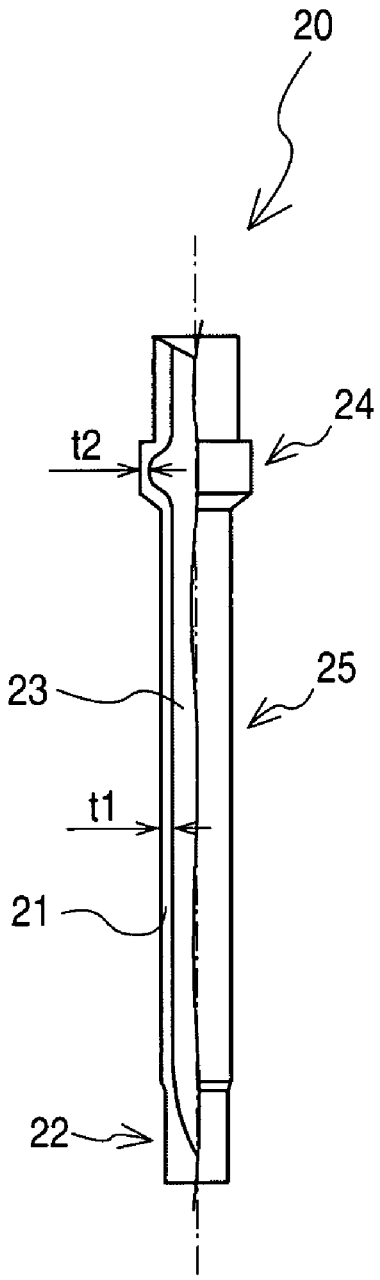
FIG. 2 is a partially sectional view illustrating a center electrode 20.

Next, the center electrode 20 will be described with reference to FIGS. 1 and 2. The center electrode 20 is a rod-like electrode having a structure where a core member (core portion) 23 which is configured by copper or a copper alloy for promoting heat radiation is embedded in a cladding shape in a center portion of an outer skin member (cover portion) 21 made of a highly refractory nickel-rich alloy. A flange portion 24 is formed in the rear end side of the center electrode 20. The flange portion 24 is engaged with a step 14 formed in the shaft hole 12 of the insulator 10, whereby the center electrode 20 is held to the tip end side in the shaft hole 12 in a state where the tip end portion 22 is projected from the tip end face of the insulator 10. The center electrode 20 comprises: a columnar middle trunk portion 25 which is smaller in diameter than the flange portion 24, on the tip end side with respect to the flange portion 24; and a tip end portion 22 which is smaller in diameter than the middle trunk portion 25, on the tip end side with respect to the middle trunk portion 25.

In the spark plug 100 of the embodiment, the outer diameter of the center electrode 20 at the middle position of the middle trunk portion 25 in the direction of the axis O is 1.9 mm. The thickness (t2) of the outer skin member 21 at the middle position of the flange portion 24 in the direction of the axis O is 0.35 mm, and the thickness (t1) of the outer skin member 21 at the middle position of the middle trunk portion 25 in the direction of the axis O is 0.25 mm. Therefore, the ratio of the thickness (t1) of the outer skin member 21 of the middle trunk portion 25 to the thickness (t2) of the outer skin member 21 of the flange portion 24 is 0.25/0.35≈0.71, and the difference between the thickness (t2) of the outer skin member 21 of the flange portion 24 and the thickness (t1) of the outer skin member 21 of the middle trunk portion 25 is 0.35−0.25=0.1 mm.

The center electrode 20 is electrically connected to the terminal post 40 which is held on the rear end side of the shaft hole 12, via a seal member 4 and resistor 3 which are disposed in the shaft hole 12. A high-voltage cable (not shown) is connected to the terminal post 40 via a plug cap (not shown) so that a high voltage is applied.

Next, the metal shell 50 will be described. The metal shell 50 is used for holding the insulator 10, and fixing the spark plug 100 to an internal combustion engine which is not shown. The metal shell 50 holds the insulator 10 so as to surround the flange portion 19, the tip end side trunk portion 17, and the long-leg portion 13, from the rear end side trunk portion 18 in the vicinity of the flange portion 19 of the insulator 10. The metal shell 50 is formed by low-carbon steel, and comprises: a tool engagement portion 51 to which a spark plug wrench that is not shown is to be fitted; and a thread portion 52 in which screw threads to be screwed with an engine head (not shown) disposed in an upper portion of the internal combustion engine are formed.

Annular ring members 6, 7 are interposed between the tool engagement portion 51 of the metal shell 50, and the rear end side trunk portion 18 of the insulator 10. A powder of talc 9 is filled between the ring members 6, 7. A crimp portion 53 is formed in the rear end side of the tool engagement portion 51. The crimp portion 53 is crimped to press the insulator 10 toward the tip end side in the metal shell 50 via the ring members 6, 7 and the talc 9. Therefore, a step 15 between the tip end side trunk portion 17 of the insulator 10 and the long-leg portion 13 is supported by a step 56 formed in the inner circumference of the metal shell 50 via a plate packing 80, and the metal shell 50 is integrated with the insulator 10. The airtightness between the metal shell 50 and the insulator 10 is held by the plate packing 80, thereby preventing a combustion gas from flowing out. A flange portion 54 is formed in a middle portion of the metal shell 50, and a gasket 5 for preventing gasses in the combustion chamber (not shown) from leaking is fitted to a screw neck portion 55 between the flange portion 54 and the thread portion 52.

Next, the ground electrode 30 will be described. The ground electrode 30 is configured by a highly corrosive-resistant metal, or, for example, a nickel alloy such as INCONEL (trademark) 600 or 601 is used. In the ground electrode 30, a section in the own longitudinal direction is substantially rectangular, and the basal portion 32 is welded to the tip end face 57 of the metal shell 50. The tip end portion 31 of the ground electrode 30 is bent so as to be opposed to the tip end portion 22 of the center electrode 20, so that a spark discharge gap is formed therebetween.

The thus configured spark plug 100 of the embodiment is miniaturized as compared with a conventional spark plug. In the center electrode 20 used in the spark plug 100, the outer diameter of the core member 23 having an excellent thermal conductivity is increased, and the thickness of the outer skin member 21 is reduced, whereby the center electrode is improved so that the heat dissipation property same as the conventional art can be maintained while the diameter is reduced.

In the spark plug 100 of the embodiment, specifically, the ratio of the thickness of the outer skin member 21 of the middle trunk portion 25 to that of the outer skin member 21 of the flange portion 24 is 0.8 or less, and hence miniaturization can be attained while ensuring the heat dissipation property of the center electrode 20. Furthermore, the ratio of the thickness of the outer skin member 21 of the middle trunk portion 25 to that of the outer skin member 21 of the flange portion 24 is 0.5 or more, and hence a mechanical strength which is sufficient for a practical use can be ensured.

In the spark plug 100 of the embodiment, the difference between the thickness of the outer skin member 21 of the flange portion 24 and that of the outer skin member 21 of the middle trunk portion 25 is 0.05 mm or more, and therefore the heat dissipation property of the center electrode 20 can be further improved. Furthermore, the thickness of the outer skin member 21 of the middle trunk portion 25 is 0.2 mm or more. Therefore, the strength of the center electrode 20 can be further improved.

Figure 3:
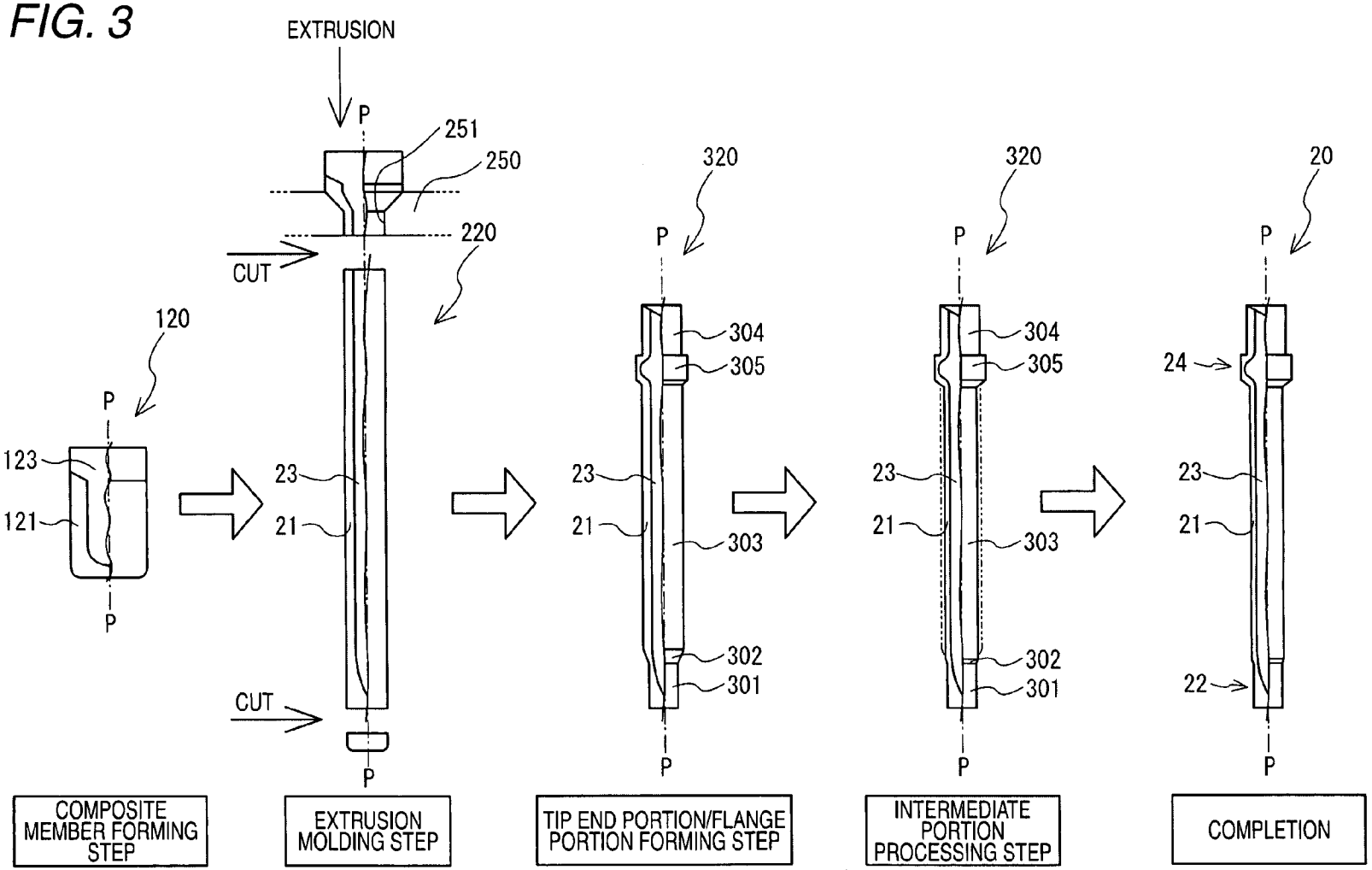
FIG. 3 is a view showing production steps of the center electrode 20.

The center electrode 20 is produced in accordance with the production method which will be described later. Hereinafter, the method of producing the center electrode 20 of the spark plug 100 will be described with reference to FIG. 3. FIG. 3 is a view showing production steps of the center electrode 20.

As shown in FIG. 3, first, a columnar nickel alloy material (in the embodiment, INCONEL (trademark) 600) which will be formed as the outer skin member 21 is formed by cold forging into a bottomed cylindrical shape to form a cup member 121. On the other hand, a copper alloy material which will be formed as the core member 23 is shaped by cold forging or a cutting process to form a flanged columnar axis member 123 which is to be fitted into a recess of the cup member 121. The both members are fitted to each other in the direction of the axis P to form an integrated composite member 120 (composite member forming step). The hardness of the circular columnar blank member which will be formed as the outer skin member 21, and which is made of INCONEL (trademark) 600 was a Vickers hardness of 160 Hv.

Next, the composite member 120 is inserted into a small-diameter hole 251 opened in a die 250, and extended in the direction of the axis P by performing extrusion molding in which the member is extruded by a punch (not shown), whereby a columnar member 220 in which the core member 23 and the outer skin member 21 are clad in a radial direction (a direction perpendicular to the axis P) is formed (extrusion molding step). In this step, the extrusion molding is performed so that the bottom wall side of the cup member 121 is on the tip end side. When the composite member 120 is extended to a desired length, a tip end portion and the rear end side are cut away to respectively obtain end faces perpendicular to the axis P, in the both ends in the direction of the axis P. As a result of the extrusion molding, the outer skin member 21 is configured into a state where the thickness is substantially uniform. The extrusion molding step corresponds to "first step" in the invention, and the columnar member 220 corresponds to "first intermediate member" in the invention.

The tip end side of the columnar member 220 is inserted into a hole which is opened in a die (not shown), and which has a smaller diameter, and then pushed by a punch to be passed therethrough, thereby performing punch molding of forming a tip end portion 301 in which only a tip end portion is reduced in diameter. At this time, a step 302 between the tip end portion 301 and an intermediate portion 303 which is on the rear end side is formed so as to be tapered. Furthermore, a rear end portion 304 which is on the rear end side of the intermediate portion 303 is pressed in the axial direction, and molded by a molding die (not shown) to form an electrode intermediate member 320 in which a flange-like flange portion 305 is formed between the rear end portion 304 and the intermediate portion 303 (tip end portion/flange portion forming step). In the intermediate portion 303, the state before the process is maintained, and the thickness of the outer skin member 21 in the region is maintained in the uniform state. The electrode intermediate member 320 corresponds to "second intermediate member" in the invention, and the tip end portion/flange portion forming step corresponds to "second step" in the invention. In the embodiment, the outer diameter of the intermediate portion 303 of the electrode intermediate member 320 is 2.1 mm. The thicknesses of the outer skin members 21 of the intermediate portion 303 and the flange portion 305 are equal to each other, and 0.35 mm. The hardness of the outer skin member 21 of the electrode intermediate member 320 was a Vickers hardness of 300 to 350 Hv.

Next, a process of polishing the whole outer circumference of the intermediate portion 303 of the electrode intermediate member 320 to reduce the thickness of the outer skin member 21 is performed (intermediate portion processing step). In this step, the outer diameter of the tip end portion 301 which is previously formed to a small diameter is set to a reference, and the whole outer circumference of the intermediate portion 303 is polished so as to be equal to or slightly larger than the outer diameter of the tip end portion 301. For example, a method in which the electrode intermediate member 320 is held in the axial direction, and polished by a grindstone is used. According to the configuration, in a state where the outer diameter of the core member 23 is maintained as it is, the center electrode 20 can be obtained in which only the thickness of the outer skin member 21 of the whole middle trunk portion 25 is reduced. Namely, there is no possibility that the thermal conductivity due to the core member 23 is reduced by performing the intermediate portion processing step. After the production steps, the center electrode 20 in which the outer diameter of the core member 23 is increased and the thickness of the outer skin member 21 is reduced is completed. The intermediate portion processing step corresponds to "third step" in the invention. In the embodiment, in the intermediate portion processing step, the outer diameter of the intermediate portion 303 is reduced from 2.1 mm to 1.9 mm. In accordance with this, the thickness of the outer skin member 21 of the intermediate portion 303 is reduced from 0.35 mm to 0.25 mm.

The thus produced center electrode 20 is inserted into the shaft hole 12 from the rear end side of the insulator 10 which is produced by another step, and which is shown in FIG. 1, and the flange portion 24 is engaged with the step 14 in the shaft hole 12. Furthermore, the terminal post 40 is inserted from the rear end side of the shaft hole 12 in a state where the seal member 4 and the resistor 3 are placed in the shaft hole 12. Next, the insulator 10 is heated in a heating oven to a predetermined temperature, the terminal post 40 is pressed from the rear end side in a state where the seal member 4 is softened, and the seal member 4 is compressed and sintered. In this way, the center electrode 20 and the terminal post 40 are fixed by the seal member 4 in the shaft hole 12 of the insulator 10, to be integrated with the insulator 10. Next, the insulator 10 is inserted into the metal shell 50 to which the ground electrode 30 is joined, and crimped. Then, the tip end portion 31 of the ground electrode 30 is bent so as to be opposed to the tip end portion 22 of the center electrode 20 to form a spark discharge gap, thereby completing the spark plug 100.

In the thus produced center electrode 20, the thickness of the outer skin member 21 is small. In order to obtain a sufficient strength, therefore, it is preferable to configure so that the hardness of the outer skin member 21 has a Vickers hardness of 270 Hv or more. In the production method of the embodiment, the step of forming the center electrode 20 comprises the extrusion molding step. Even when the hardness of the circular columnar blank member which will be formed as the outer skin member 21 has a Vickers hardness of less than 270 Hv, therefore, the hardness of the outer skin member 21 of the electrode intermediate member 320 after the tip end portion/flange portion forming step can be set to a Vickers hardness of 270 Hv or more, and it is possible to prevent the electrode intermediate member 320 from being broken in the subsequent intermediate portion processing step. By contrast, in the case where the outer skin member 21 is configured so as to have a Vickers hardness of less than 270 Hv, the strength is insufficient, and there is the possibility that, when externally shocked during the intermediate portion processing step or after the completion of the center electrode 20, bending occurs or breakage is caused by expansion of the core member 23. As a nickel alloy which is useful as the outer skin member 21 of the center electrode 20, in addition to INCONEL (trademark) 600 which has been described above, a nickel alloy such as 601 is preferably used. As a material which is excellent in corrosion resistance at a high temperature, and durability against cutting and polishing, preferably useful is a nickel alloy which contains 60 to 70 wt. % of nickel, 20 to 30 wt. % of chromium, 7 to 20 wt. % of iron, 1 to 5 wt. % of aluminum, and 0.5 to 1 wt % of a total of zirconium and yttrium. In order to improve the strength of the nickel alloy, it is preferable to further contain 0.12 to 0.5 wt. % of carbon.

In order to ascertain the effects of the invention, experiments were conducted. Five kinds of spark plugs (sample Nos. 1 to 5) which are identical with one another except the center electrode, and in which, in the center electrode, the thickness of the outer skin member of the middle trunk portion, and that of the outer skin member of the flange portion were variously changed were produced. Here, center electrodes were prepared in which the thickness of the outer skin member of the middle trunk portion, and that of the outer skin member of the flange portion were changed as in Table 1 so that the outer diameter of the middle trunk portion of the center electrode at completion is 1.9 mm. In the center electrodes of the spark plugs of sample Nos. 1 to 5, the outer diameter of the intermediate portion after the above-mentioned tip end portion/flange portion forming step is larger than 1.9 mm, and, in the above-mentioned intermediate portion processing step, the outer circumference of the intermediate portion is polished to set the outer diameter of the intermediate portion to 1.9 mm. As a spark plug of a conventional example which is to be compared, a spark plug comprising a center electrode in which the intermediate portion processing step is not performed (i.e., the outer circumference of the intermediate portion is not polished), and the outer diameter of the intermediate portion after the above-mentioned tip end portion/flange portion forming step is 1.9 mm was prepared. The spark plugs of sample Nos. 1 to 5 were evaluated for the heat dissipation property. The results are shown in Table 1.

In the evaluation for the heat dissipation property, the six kinds of spark plugs (sample Nos. 1 to 5 and the conventional example) were heated by a burner so that the temperatures of the tool engagement portions of the metal shells of the spark plugs were equal to one another, and the temperatures of the tip end portions of the center electrodes of the spark plugs were measured by a radiation thermometer. In the spark plugs of sample Nos. 1 to 5, a spark plug in which the temperature of the tip end portion of the center electrode was lower by 50° C. or more than that of the tip end portion of the center electrode of the conventional example was evaluated as "O", and a spark plug in which the temperature was lower by less than 50° C. was evaluated as "x".

TABLE 1

| Sample No. | Thickness t1 of outer skin member of middle trunk portion (mm) | Thickness t2 of outer skin member of flange (mm) | Ratio t1/t2 | Heat dissipation property | Breakability |
|---|---|---|---|---|---|
| 1 | 0.25 | 0.35 | 0.71 | ○ | ○ |
| 2 | 0.28 | 0.35 | 0.8 | ○ | ○ |
| 3 | 0.21 | 0.35 | 0.6 | ○ | ○ |
| 4 | 0.2 | 0.25 | 0.8 | ○ | x |
| 5 | 0.315 | 0.35 | 0.9 | x | — |
| Conventional example | 0.35 | 0.35 | 1 | — | — |

As shown in Table 1, in the center electrode of the spark plug of sample No. 5, the ratio of the thickness of the outer skin member of the middle trunk portion to that of the outer skin member of the flange portion exceeds 0.8, and hence the heat dissipation property was poor. By contrast, in the center electrodes of the spark plugs of sample Nos. 1 to 4, the ratio of the thickness of the outer skin member of the middle trunk portion to that of the outer skin member of the flange portion is 0.8 or less, the heat dissipation property was excellent.

Furthermore, the center electrodes of the spark plugs of sample Nos. 1 to 4 in which the evaluation for the heat dissipation property was excellent were evaluated for breakbility. In the evaluation for breakbility, 10 center electrodes were produced for each of the spark plugs of sample Nos. 1 to 4, and it was checked whether a breakage occurred in each of the center electrodes after the intermediate portion processing step or not. When a breakage did not occur in the 10 produced center electrodes, the corresponding sample was evaluated as "O". When a breakage occurred in even one center electrode, the sample was evaluated as "x". The results also are shown in Table 1.

As shown in Table 1, in the center electrodes of the spark plugs of sample Nos. 1 to 3, the thickness of the outer skin member is 0.3 to 0.4 mm. Therefore, no breakage occurred in the center electrodes after the intermediate portion processing step, and the center electrodes had a sufficient mechanical strength. By contrast, in the center electrode of the spark plug of sample No. 4, the thickness of the outer skin member is 0.25 mm or less than 0.3 mm. Therefore, a breakage occurred in the center electrode after the intermediate portion processing step, and the center electrode had a low mechanical strength.

It is a matter of course that the invention can be variously modified. In the embodiment, for example, a nickel alloy was used as the outer skin member 21. However, the invention is not restricted to this. For example, an iron alloy and the like may be used, and it is preferable to use a material having a high spark wear resistance. As the core member 23, in addition to copper or a copper alloy which was used in the embodiment, a highly thermally conductive material such as a high-purity nickel alloy (for example, an alloy containing 80 or more wt. % of nickel) or a silver alloy which is higher in conductivity than the outer skin member 21 may be used.

In the embodiment, the outer skin member 21 of the center electrode 20 was thinned by cutting the intermediate portion 303. Alternatively, the surface of the intermediate portion 303 may be shaved off by rotating the electrode intermediate member 320 held in the axial direction about the axial center, and applying a cutting blade on the intermediate portion 303. Centerless polishing may be performed in a state where the movement of the electrode intermediate member 320 is restricted so that the flange portion 305 is not contacted with the grindstone.

In the embodiment, in the intermediate portion processing step, the whole outer circumference of the intermediate portion 303 of the electrode intermediate member 320 is polished. In order to accurately thin the outer skin member 21 in the vicinity of the flange portion 24, however, it is preferable to perform a cutting process in the vicinity of the flange portion 24. When a cutting process is applied to the vicinity of the flange portion 24, thinning can be accurately performed so as to reach the boundary between the middle trunk portion 25 and the flange portion 24. When a cutting process is applied, the radius of curvature of a curved face which is formed between the middle trunk portion 25 and the flange portion 24 can be set to 0.085 mm or less. When a center electrode having such a radius of curvature is used in a spark plug, the adhesiveness between the flange portion and the insulator can be enhanced, and the heat dissipation property of the center electrode can be further improved.

Figure 4:
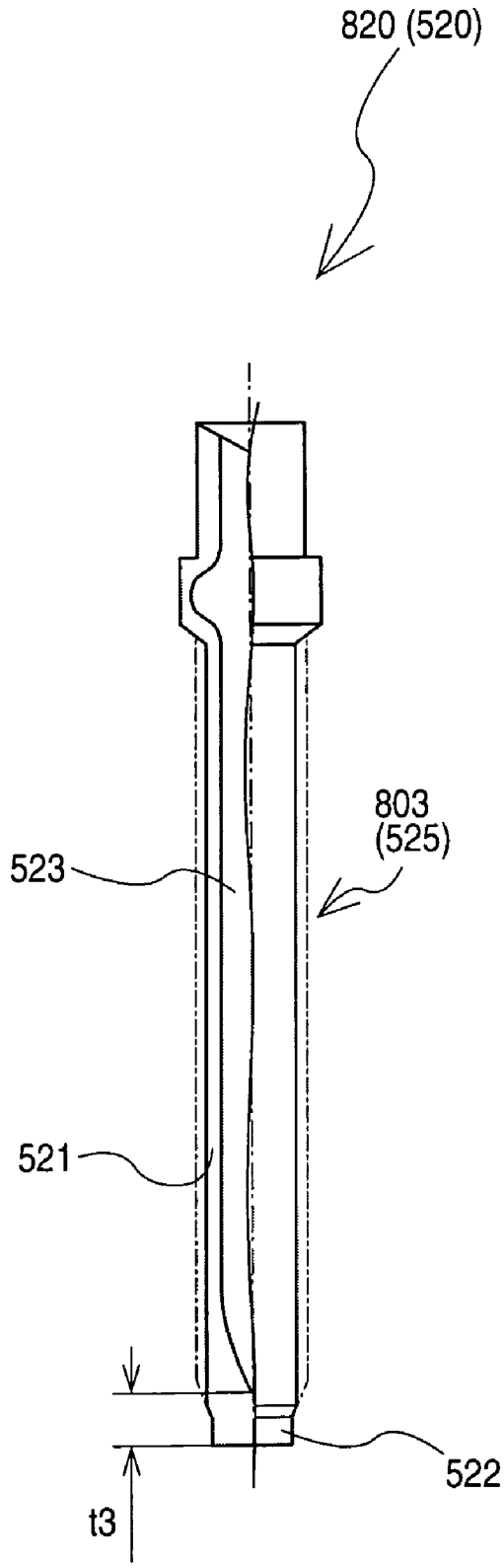
FIG. 4 is a view showing a modification of a step of processing an intermediate portion.

In order to effectively obtain the heat dissipation property of the center electrode, in a configuration in which the tip end of a core member 523 is positioned in an intermediate portion 803 as shown in FIG. 4, showing an electrode intermediate member 820, the surface of an outer skin member 521 of an intermediate portion 803 may be cut or polished to a portion corresponding to the tip end of the core member 523. In this way, the outer skin member 521 is cut or polished till the tip end of the core member 523 in the intermediate portion 803, whereby the outer skin member 521 in the region where the core member 523 is positioned in a middle trunk portion 525 can be thinned, and the heat dissipation property of a center electrode 520 can be effectively obtained.

Figure 5:
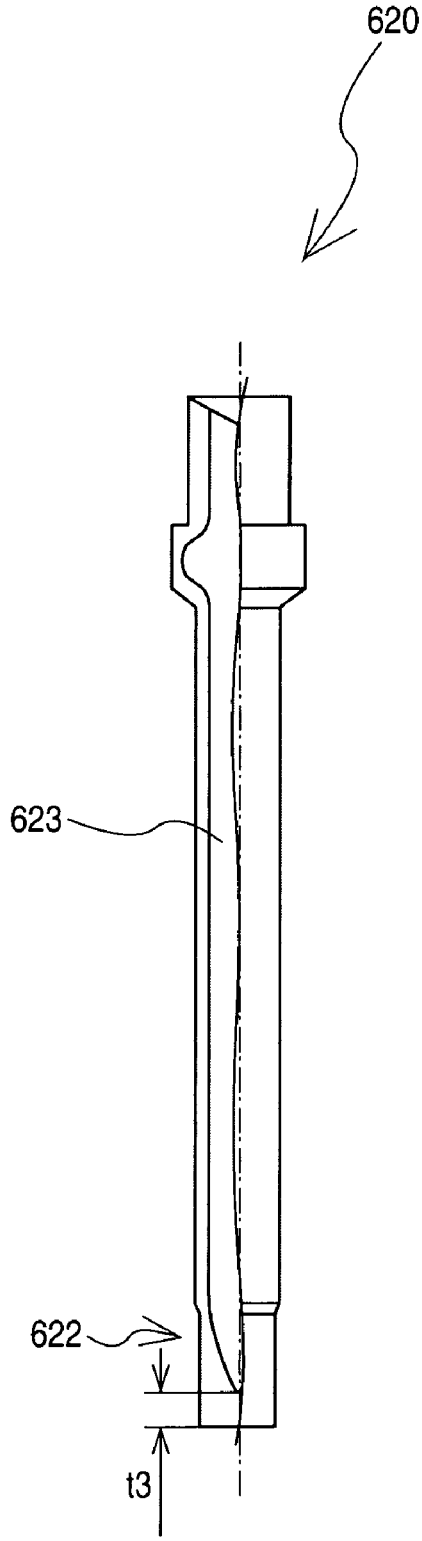
FIG. 5 is a view showing a modification of the center electrode.

In order to improve the heat dissipation property of the tip end portion of the center electrode, it is preferable to set the distance t3 between the tip end of a center electrode 520 or 620 and that of a core member 523 or 623 to 2 mm or less as shown in FIGS. 4 and 5. According to the configuration, heat conducted from the tip end of the center electrode 520 or 620 can be promptly transmitted to the core member 523 or 623, whereby a spark plug in which the heat dissipation property of the tip end portion 522 or 622 of the center electrode 520 or 620 is improved can be obtained.

The invention is not restricted to the embodiment and the drawings, and can be adequately changed without departing from the spirit of the invention. In the center electrodes 20, 520, 620 and the ground electrode 30 of the embodiment, for example, a known noble metal tip may be used at a position opposed to the spark discharge gap. A core member made of copper or a copper alloy may be embedded also in the ground electrode 30.

In the embodiment, the outer diameter of the tip end portion 22 is smaller than that of the middle trunk portion 25. Alternatively, the diameters may be equal to each other. In the alternative, the electrode intermediate member 320 in which the tip end portion 301 and the intermediate portion 303 have the same diameter is previously formed, and the outer circumferential faces of the outer skin members 21 in both the tip end portion 301 and the intermediate portion 303 are cut or polished, thereby obtaining small diameters.

Although the invention has been described in detail and with reference to the specific embodiment, it is obvious to those skilled in the art that various modifications and variations are possible without departing the spirit and scope of the invention.

The application is based on Japanese Patent Application (No. 2006-068485) filed Mar. 14, 2006, and its disclosure is incorporated herein by reference.

The invention claimed is:

1. A method of producing a spark plug comprising a center electrode which includes a core portion, and a cover portion covering said core portion, wherein said method comprises:

a first step of applying a plastic working process on a blank member which is configured by joining a material that will be used as said core portion, to a material that will be used as said cover portion, thereby forming a first intermediate member which is columnar, and in which said cover portion covers said core portion;

a second step of applying a plastic working process on said first intermediate member to form a second intermediate member having: a tip end portion; a bulging flange portion which is disposed on a rear end side with respect to said tip end portion, and which has a larger diameter than said tip end portion; and a columnar intermediate portion which is disposed between said tip end portion and said flange portion; and a third step of cutting or polishing a surface of said cover portion of said intermediate portion of said second intermediate member to form said center electrode having a middle trunk portion which is configured by reducing a diameter of said intermediate portion.

2. The method of producing a spark plug according to claim 1, wherein, in said second intermediate member, said cover portions in an axial center of said intermediate portion and said flange portion have a thickness of 0.3 to 0.4 mm.

3. The method of producing a spark plug according to claim 1, wherein a hardness of said cover portion of said center electrode has a Vickers hardness of 270 Hv or more.

4. The method of producing a spark plug according to claim 1, wherein, in said third step, said surface of said cover portion of said intermediate portion of second intermediate member is cut or polished so that a ratio of a thickness of said cover portion of said middle trunk portion to a thickness of said cover portion of said flange portion is 0.8 or less.

5. The method of producing a spark plug according to claim 1, wherein, in said third step, said surface of said cover portion of said intermediate portion of second intermediate member is cut or polished so that a difference between a thickness of said cover portion of said flange portion and a thickness of said cover portion of said middle trunk portion is 0.05 mm or more.

6. The method of producing a spark plug according to claim 1, wherein said intermediate portion has a length which is equal to one half or more of a whole length of said second intermediate member.

7. The method of producing a spark plug according to claim 1, wherein, in said third step, said surface of said cover portion of said intermediate portion is cut or polished over a whole length of said core portion positioned in said intermediate portion.

* * * * *